United States Patent [19]

Bittner

[11] Patent Number: 4,683,790

[45] Date of Patent: Aug. 4, 1987

[54] DISC CUTTER MACHINE, IN PARTICULAR FOR CUTTING SUGAR BEET

[75] Inventor: Hans-Joachim Bittner, Hagen, Fed. Rep. of Germany

[73] Assignee: H. Putsch GmbH & Comp., Hagen, Fed. Rep. of Germany

[21] Appl. No.: 787,775

[22] Filed: Oct. 15, 1985

[30] Foreign Application Priority Data

Nov. 26, 1984 [DE] Fed. Rep. of Germany ..... 3443032

[51] Int. Cl.[4] ..... B26D 1/00

[52] U.S. Cl. ..... 83/356.3; 83/592; 83/663; 241/92

[58] Field of Search ..... 241/92; 83/356.3, 355, 83/591, 592, 663

[56] References Cited

U.S. PATENT DOCUMENTS

| | | | |
|---|---|---|---|
| 365,467 | 6/1887 | Freese | 83/663 |
| 555,002 | 2/1896 | Hanahan | 241/92 |
| 762,579 | 6/1904 | Dufford | 83/165 |
| 1,075,624 | 10/1913 | Binkley . | |
| 1,230,329 | 6/1917 | Sailer . | |
| 1,241,702 | 10/1917 | Binkley et al. . | |
| 1,474,797 | 11/1923 | Spicer . | |
| 1,642,705 | 9/1927 | Tuttle . | |
| 2,712,904 | 7/1955 | Durkee | 241/92 |
| 2,796,103 | 6/1957 | Feinstein | 83/356.3 |
| 2,846,004 | 8/1958 | Fotland | 83/591 X |
| 2,884,974 | 5/1959 | Woodward, Jr. . | |
| 2,922,590 | 11/1960 | Bland | 241/92 |
| 3,061,207 | 10/1962 | Clark | 241/92 |
| 3,139,127 | 6/1964 | Urschel et al. . | |
| 4,391,172 | 7/1983 | Galland et al. | 83/403 |

FOREIGN PATENT DOCUMENTS

| | | |
|---|---|---|
| 116925 | 7/1899 | Fed. Rep. of Germany . |
| 328166 | 2/1970 | U.S.S.R. . |

OTHER PUBLICATIONS

Urschel Model "Y" Brochure, Jan. 18, 1965, Urschel Laboratories, Valparasio, Ind.

*Primary Examiner*—E. R. Kazenske
*Assistant Examiner*—Scott A. Smith
*Attorney, Agent, or Firm*—Bernard, Rothwell & Brown

[57] ABSTRACT

In order to further develop a disc cutter machine, in particular for cutting sugar beet, which is provided with a machine frame, a disc cutter having passages for the cut material, and blade receivers arranged in the region of the passages, in such manner that with the same disc cutter diameter a higher cutting output can be achieved, the blade receivers (18) are mounted on the flat upper surface (16) of the disc cutter (12) and the disc cutter is formed in the region of the blade receivers of radially extending and uniformly spaced inclined ribs (14).

10 Claims, 3 Drawing Figures

DISC CUTTER MACHINE, IN PARTICULAR FOR CUTTING SUGAR BEET

The present invention relates to a disc cutter machine, in particular for cutting sugar beet, comprising a machine frame, a disc cutter having a flat upper side and uniformly distributed passages for the cut product preferably longitudinal and extending in the radial direction, blade receivers arranged in the region of the passages, and a bearing and a drive for the disc cutter.

In disc cutter machines of the known type, the disc cutters usually consist of a steel plate from which rectangular sections are removed to form the passages for the cut product. In the passages, the blade receivers are inserted which carry the blades for the cutting process.

Since the cutting output is dependent upon the number of blades and thus the number of blade receivers, it is endeavoured to provide as many blade receivers as possible in the disc cutter. Moreover, it is attempted to form the disc cutter to be as stiff as possible since on the one hand considerable axial pressure caused by the raw beet loading the disc cutter must be resisted by means of the disc cutter and on the other hand a considerable torque for the cutting process must be resisted in the peripheral direction.

The requirement for a construction of the disc cutter which is as stiff as possible conflicts however, from the constructional point of view, with the requirement to provide as many blade receivers as possible. With a predetermined diameter of the disc cutter, an increase of the number of blade receivers leads to a reduction of the width of the portions of the disc cutter remaining between the blade receivers and thus necessarily leads to a reduction of stiffness. To this extent, the number of blade receivers is set within tight limits with a predetermined diameter of disc cutter as a result of the constructional necessities, and in addition reduction of the width of the blade receivers is not possible for technical reasons.

An object of the present invention is to develop a disc cutter machine of the type mentioned in the introduction in such manner that with the same disc cutter diameter a high cutting output can be achieved.

This object is achieved in accordance with the invention in that the blade receivers are provided on the upper side of the disc cutter and the disc cutter is formed in the region of the blade receivers of radial uniformly spaced inclined ribs.

By the features according to the invention, a completely new concept is effected. Thus, on the one hand the blade receivers are mounted for the first time on the upper side of the disc cutter and are no longer set into this. As a result, the blade receivers can be arranged at a very close mutual spacing so that a disc cutter of the type according to the invention can carry a larger number of blade receivers than a conventional disc cutter construction of the same diameter, whereby the cutting output is increased. On the other hand, in the new conception the practically square bridge pieces present in the earlier disc cutters are replaced by narrow and inclined ribs arranged beneath the blade receivers. These ribs can be appropriately dimensioned in terms of their height to meet strength requirements without considerable increase of the weight of the disc cutter. In this manner, with relatively small material expenditure a large rigidity against bending is achieved. As a result of the inclined positioning of the ribs, moreover two advantages are achieved by the concept according to the invention. Thus, the cut material does not fall during the cutting process in the known manner in the axial direction of the disc cutter through the passages, but exits at a sharp angle to the plane of the disc cutter from the blade receivers. As a result of the inclined position, the ribs extend approximately parallel to the outlet angle of the cut material so that an unhindered exit of product and little damage to the product takes place. As a result of the inclined position of the ribs, the disc cutter is furthermore provided with large rigidity in the peripheral direction as a result of which the disc cutter can absorb the occasionally considerable torque necessary for the cutting process without significant distortion.

Disc cutter machines constructed according to the invention thus have higher cutting output than the known disc cutter machines of the usual construction as a result of the increased number of blade receivers. The disc cutters themselves have in addition a considerably higher stability compared with the disc cutters of the usual type, in particular in the axial direction.

According to an advantageous further development of the invention, the height of the ribs increases in a direction towards the disc cutter axis. In this manner, the ribs can be optimally constructed with a view to rigidity in accordance with the bending moment pattern.

In a preferred exemplary embodiment of a disc cutter machine according to the invention, the inclined ribs of the disc cutter are connected in the region of their inner ends facing towards the axis of the disc cutter to a hub ring and in the region of their outer ends to a peripheral ring. Such a construction represents an optimal technical solution.

In disc cutter machines of the type described in the introduction, there exists the requirement that the cut material, in the case of processing of raw beet the so-called "shavings", is treated as carefully as possible, i.e. is not damaged. According to a preferred exemplary embodiment, for this reason the angle of the inclined position of the ribs corresponds approximately to the outlet angle of the cut product from the blade receivers. A preferred angle is approximately 45°.

As mentioned in the introduction, an essential feature of the concept according to the invention is the arrangement of the blade receivers on the upper side of the disc cutter. In order to fix the blade receivers on the disc cutter in the position necessary for an optimal cutting operation, it is expedient to arrange centering tongues on the upper side of the disc cutter which engage in centering recesses on the blade receivers. The centering tongues and the centering recesses can be configured in any desired manner. It is only necessary that both means for radial centering and also means for centering in the peripheral direction are provided.

In disc cutter machines of the known type, i.e. those in which the blade receivers are provided in the passages, for protection of the disc cutter, in particular between the blade receivers on the upper side of the disc cutter, so-called wear elements must be arranged.

These wear elements must be exchanged at regular intervals for which purpose in known disc cutter machines disassembly of the entire machine is necessary. According to an advantageous further development of the present invention, the blade receivers are constructed at least in the region of their upper side in the form of a trapezium and are arranged closely together in such manner that they completely cover the upper side of the disc cutter in the region of the passages for the cut product. In this manner it is possible to arrange the wear elements on the blade receivers themselves. This gives the possibility to service the wear elements at short intervals, i.e. at every exchange of the blade receivers, whereby the formerly necessary expensive disc cutter removal which necessitates disassembly of the machine need only be carried out at considerably longer intervals of time.

Disc cutters of the present type are equipped with wear elements both between the blade receivers and also radially outwardly and inwardly of the blade receivers. Since the blade receivers according to the invention are no longer provided within the disc cutter but are mounted above this, the possibility exists of constructing the wear elements lying outwardly in the peripheral direction more narrowly than before. Experiments have proved that as a result of the narrow construction the friction in the vicinity of these wear elements which cannot be prevented can be considerably reduced which has positive effects on the drive power. As a result of the narrow construction of the wear elements lying radially outwardly, a trailing edge is thus formed which reduces the tendency for adhesion of crushed beet waste (so-called mash). This thus produces a decrease in friction.

A further advantage of the trapezium-shaped construction of the blade receivers consists in that these can be configured to be more stable, which is particularly favourable when aluminium extruded alloys are used.

Disc cutter machines of the known type have previously had, for mounting of the disc cutter, a bearing journal mounted in the drum bearing in the middle of the disc cutter. As a result of the unfavourable lever arm ratio considerable forces are exerted in such a construction on the bearing as a result of which this must be of large dimensions and therefore expensive.

According to an advantageous further development, in a cutter machine according to the invention the bearing is arranged in the region of the hub ring. By this measure, the bearing is shifted for the first time from the region of the middle of the cutter disc directly to that position on which the cutting force is exerted. As a result, even with small bearing dimensions an extremely rigid bearing is achieved.

As a result of the displacement of the bearing from the region of the center of the cutting disc moreover space is made available across the cutting disc for the drive as a result of which the constructional height is reduced.

The bearing according to the invention in the region of the hub ring can be constructed in various ways. It is however advantageous if this bearing is constructed as a transverse longitudinal bearing.

In order to reduce the constructional height further, the drive can, according to a further advantageous development of the invention, be shifted at least partially inwards to the center of the hub ring.

In a preferred exemplary embodiment of the invention, the output of the drive is connected to a drive wheel which is coupled on the lower side of the hub ring. With such a construction, not only a technically advantageous transmission of the drive forces to the disc cutter is achieved but moreover the bearing arrangement is completely covered from below. The drive wheel thus has also the function of a closure plate for protecting the bearing which is particularly of advantage for disc cutter machines for cutting of sugar beet as a result of the large amount of waste.

In order to permit exact adjustment of the gap between the wear elements of the blade receivers and the abrasion elements of the machine frame, it is advantageous to mount the disc cutter together with the bearing and the drive to be displaceable in the disc cutter axial direction in the machine frame.

In the following for further explanation and for better understanding an exemplary embodiment of a disc cutter machine according to the invention is described in more detail with reference to the accompanying drawings, in which.

Figure 1:
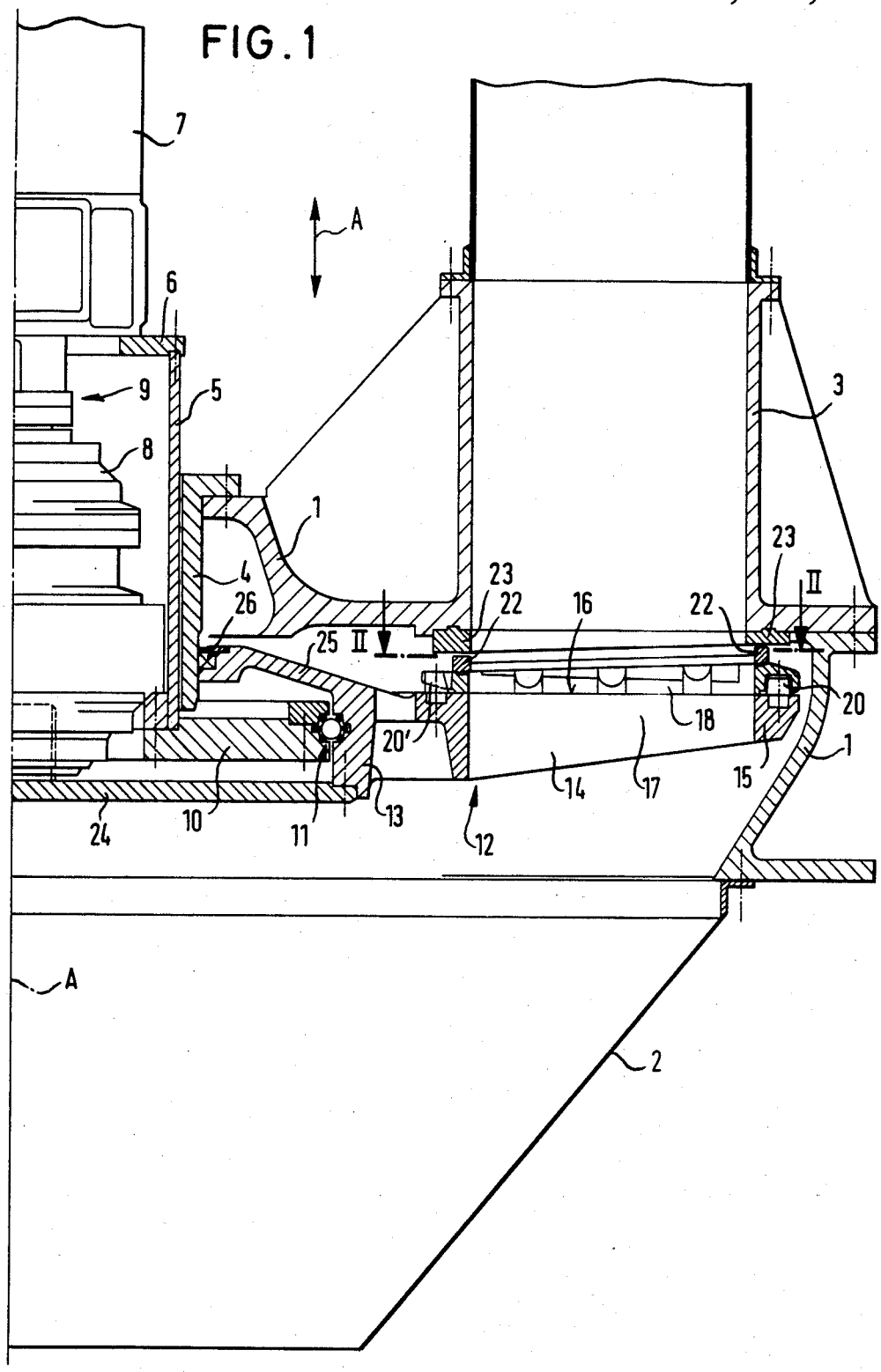
FIG. 1 shows schematically a disc cutter machine of the type according to the invention in a vertical half section.

As may be seen from FIG. 1, the disc cutter machine comprises a machine frame 1 on whose open lower end a collection funnel 2 is connected. In the machine frame 1 is integrated a delivery channel 3 for the material to be cut in known manner. In its center, the machine frame 1 possesses a bearing socket 4 vertically arranged with reference to its axis in whose bore a tubular drive housing 5 is mounted for vertical displacement. The drive housing 5 comprises in the region of its upper end a flange 6 on whose upper side a drive motor 7 is mounted. The drive motor 7 is connected to a transmission 8 mounted within the drive housing 5. The drive motor 7 and the transmission 8 form the drive 9 of the disc cutter machine.

In the region of its lower end, the drive housing 5 is connected to an annular bearing carrier 10 which carries in the region of its periphery a bearing 11. By means of the bearing 11, a disc cutter 12 is rotatably mounted on the annular bearing carrier 10. In this connection, the arrangement is such that the axis of rotation A of the disc cutter coincides with the axis of the drive 9.

The disc cutter 12 consists substantially of a hub ring 13 carrying the bearing 11 on the outer side of which hub ring substantially radially extending ribs 14 are connected which are inclined by approximately 45°. The outer ends of the rings 14 facing away from the hub ring 13 are in turn connected to a peripheral ring 15 arranged concentrically to the hub ring 13, which peripheral ring 15 forms the radial outward boundary of the disc cutter 12. The inclined ribs 14 have a substantially L-shaped configuration as appears clearly from FIG. 3.

The outer surface of the hub ring 13 facing away from the axis A of the disc cutter 12 forms together with the inner surface of the peripheral ring 15 and the mutually facing lateral surfaces of the ribs 14 passages 17 for the cut material. The upper side of the hub ring 13, the ribs 14 and the peripheral ring 15 thus lie in one plane so that a flat upper side 16 results. On the flat upper side 16 closely spaced blade receivers 18 are arranged as may be seen clearly from FIG. 2. As a result of the L-shaped configuration of the ribs 14, the mounting surface for the blade receivers 18 is relatively large. The blade receivers 18 have a substantially trapezium-shaped configuration so that they completely cover the flat upper surface 16 of the disc cutter 12.

With the exception of the trapezium-shaped configuration, the blade receivers 18 are constructed in the conventional manner, in particular in respect of the securing of the blades 19.

On the flat upper surface 16 of the disc cutter 12, are arranged centering projections 20 and 20' in the region of the hub ring 13 and the peripheral ring 15 which projections engage in corresponding centering recesses in the blade receivers 18.

Figure 3:
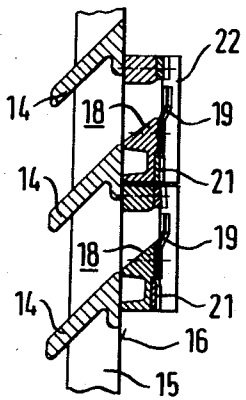
FIG. 3 shows a section along the plane III—III of FIG. 2.
Figure 2:
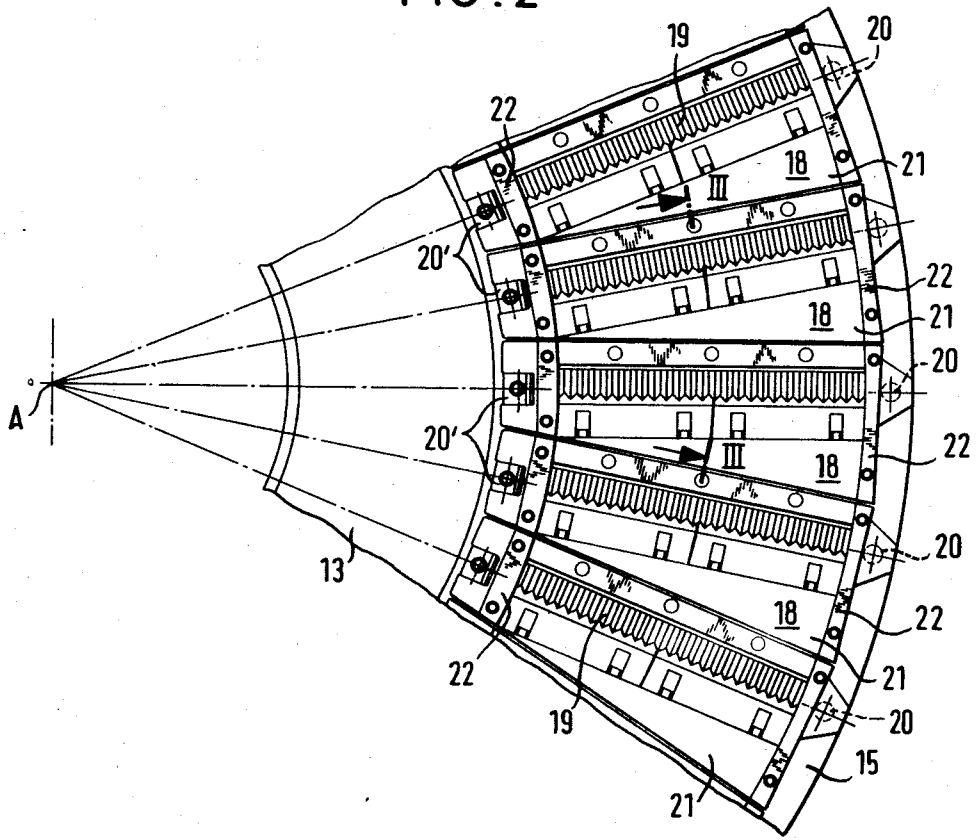
FIG. 2 shows a section along the plane II—II of FIG. 1.

As may be seen from FIGS. 2 and 3, the upper side of the blade receivers 18 between the blades 19 is covered with wear elements 21. These wear elements 21 are supplemented in the region of their radially inner and outer ends by ridge-like further wear elements 22 as may be seen particularly from FIGS. 1 and 2. By means of the wear elements 22, further wear elements 23 are secured in the region of the lower end of the delivery channel 3.

As appears from FIG. 1, the height of the ribs 14 decreases from the hub ring 13 to the peripheral ring 15. In this manner, the ribs 14 can be optimally configured according to the bending moment distribution with regard to strength.

As furthermore appears from FIG. 1, on the lower side of the hub ring 13 a drive plate 24 is secured. In the region of its center, the drive plate is coupled to the output of the drive 9. By way of the drive plate 24, the torque is delivered from the drive 9 to the disc cutter 12 and the bearing 11 is well protected from below against external effects. For protection of the bearing upwardly, a cover ring 25 is connected to the hub ring 13 and covers the bearing carrier 10. This cover ring 25 has a sealing arrangement 26 in the region of its end facing towards the axis A, which sealing arrangement abuts the outer side of the bearing socket 4. The bearing 11 is thus hermetically sealed against external influences.

For adjustment of the gap between the wear elements 22 of the blade receivers 18 are the wear elements 23 of the delivery channel 3, it is only necessary to displace the drive housing 5 in the bearing socket 4 in the vertical direction indicated by double-ended arrow A in FIG. 1. The adjusting means necessary for this are not illustrated in FIG. 1 for improved clarity.

I claim:

1. Disc cutter machine, in particular for cutting of sugar beet, comprising a machine frame, a disc cutter having a flat upper surface and having uniformly distributed passages extending longitudinally and in the radial direction, for the cut product, comprising blade receivers arranged in the region of the passages and a bearing and drive for the disc cutter, wherein the blade receivers are mounted on the upper surface of the disc cutter and the disc cutter is comprised of inclined ribs extending radially and at a uniform mutual spacing to define said passages in the region of the blade receivers wherein the inclined ribs are connected in the region of their inner ends facing the disc cutter axis to the hub ring and in the region of their outer ends to a peripheral ring of the disc cutter, and wherein the height of the ribs increases towards the disc cutter axis.

2. Disc cutter machine according to claim 1 wherein the angle of the inclined position of the ribs corresponds approximately to the outlet angle of the cut material from the blade receivers.

3. Disc cutter machine according to claim 1 wherein centering projections are arranged on the flat upper surface of the disc cutter and engage in centering recesses on the blade receivers.

4. Disc cutter machine according to claim 1 wherein the blade receivers are formed at least in the region of their upper surface in the shape of a trapezium and are arranged closely together in such manner that they completely cover the upper surface of the disc cutter in the region of the passages for the cut material.

5. Disc cutter machine according to claim 4 wherein wear elements are secured on the upper surface of the blade receivers.

6. Disc cutter machine according to claim 1 wherein the bearing is arranged in the region of the hub ring.

7. Disc cutter machine according to claim 6 wherein the bearing is formed as a transverse longitudinal bearing.

8. Disc cutter machine according to claim 6 wherein the drive is arranged at least partially within the hub ring.

9. Disc cutter machine according to claim 8 wherein the output of the drive is connected to a drive plate which is coupled to the lower side of the hub ring.

10. Disc cutter machine according to claim 6 wherein the disc cutter together with the bearing and the drive is axially displaceable with respect to the machine frame.

* * * * *